US007740233B1

(12) United States Patent
Larsen

(10) Patent No.: US 7,740,233 B1
(45) Date of Patent: Jun. 22, 2010

(54) FENCE ASSEMBLY AND RELATED METHODS

(76) Inventor: Charles Larsen, 618 10th St., Huntington Beach, CA (US) 92648

( * ) Notice: Subject to any disclaimer, the term of this patent is extended or adjusted under 35 U.S.C. 154(b) by 678 days.

(21) Appl. No.: 11/099,914

(22) Filed: Apr. 6, 2005

(51) Int. Cl.
*E04H 17/04* (2006.01)
*E04H 17/14* (2006.01)
*E04H 17/16* (2006.01)

(52) U.S. Cl. ..... 256/47; 256/24; 256/26; 256/45

(58) Field of Classification Search ..... 256/33, 256/47, 48, 49, 50, 54, 57, 24, 26, 45; 119/514
See application file for complete search history.

(56) References Cited

U.S. PATENT DOCUMENTS

| | | | | | |
|---|---|---|---|---|---|
| 1,641,872 | A | * | 9/1927 | Southwell | |
| 2,534,410 | A | * | 12/1950 | Brickman | 256/47 |
| 2,968,470 | A | * | 1/1961 | Pellerito et al. | 256/47 |
| 4,553,740 | A | * | 11/1985 | Bailey | 47/44 |
| 4,836,143 | A | * | 6/1989 | Shadbolt, Jr. | 119/514 |
| 4,899,990 | A | * | 2/1990 | Winders et al. | 256/57 |
| 4,910,933 | A | * | 3/1990 | Schwarzfeller et al. | 256/47 |
| 5,275,382 | A | | 1/1994 | Charbaut et al. | 256/48 |
| 5,542,649 | A | * | 8/1996 | Allegaert et al. | 256/47 |
| 6,581,914 | B2 | | 6/2003 | Saura Sotillos et al. | 256/73 |
| 2003/0209701 | A1 | | 11/2003 | Goddard | 256/47 |

FOREIGN PATENT DOCUMENTS

| | | | |
|---|---|---|---|
| DE | 1863758 | U * | 12/1962 |
| DE | 3824721 | A1 * | 4/1990 |
| DE | 19608304 | A1 * | 8/1997 |
| DE | 2004003897 | U1 * | 8/2004 |
| EP | 98328 | A1 * | 1/1984 |
| EP | 368778 | A1 * | 5/1990 |
| EP | 481100 | A1 * | 4/1992 |
| ES | 2154181 | A1 * | 3/2001 |
| FR | 2529935 | A1 * | 1/1984 |
| FR | 2555639 | A1 * | 5/1985 |
| FR | 2611428 | A1 * | 9/1988 |
| FR | 2735171 | A1 * | 12/1996 |
| GB | 1032475 | A1 * | 6/1966 |
| GB | 2400120 | A * | 10/2004 |

* cited by examiner

*Primary Examiner*—Daniel P Stodola
*Assistant Examiner*—Ernesto Garcia
(74) *Attorney, Agent, or Firm*—J. Mark Holland & Associates

(57) ABSTRACT

Fence apparatus and related methods for making a fence panel and for connecting the panel to other panels and post elements to form a modular type fence are disclosed. These include a generally planar section of fencing material formed from spaced-apart wires, and the related brackets and posts of the system providing simplified installation, removal, handling, and storage of the fence components.

4 Claims, 14 Drawing Sheets

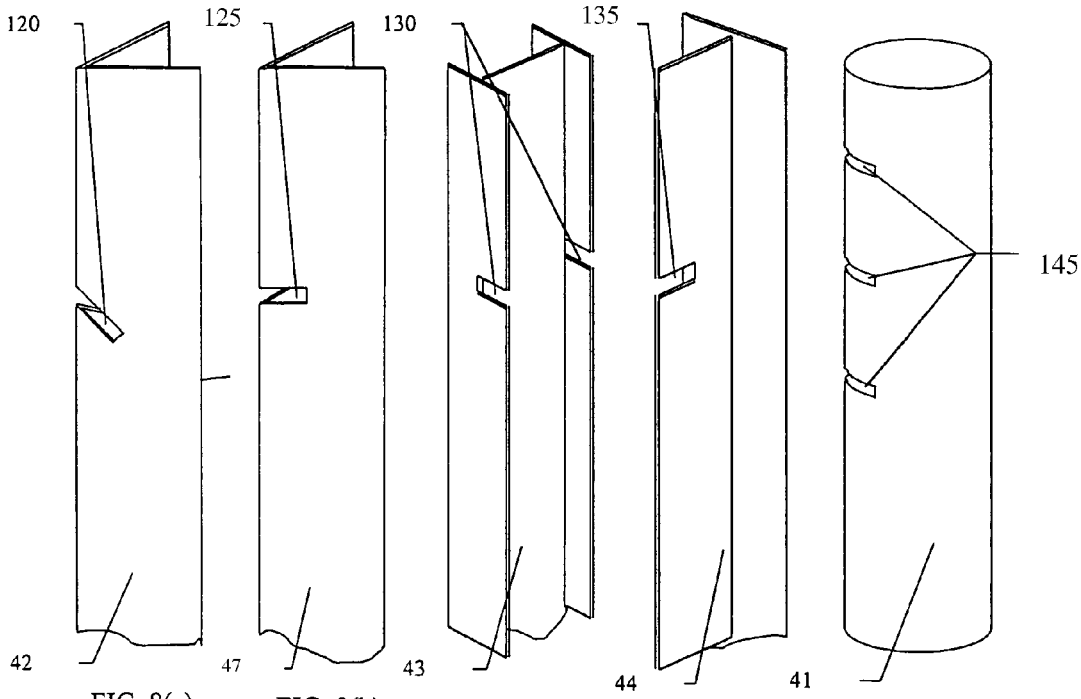
FIG. 8(a) FIG. 8(b) FIG. 8(c) FIG. 8(d) FIG. 8(e)
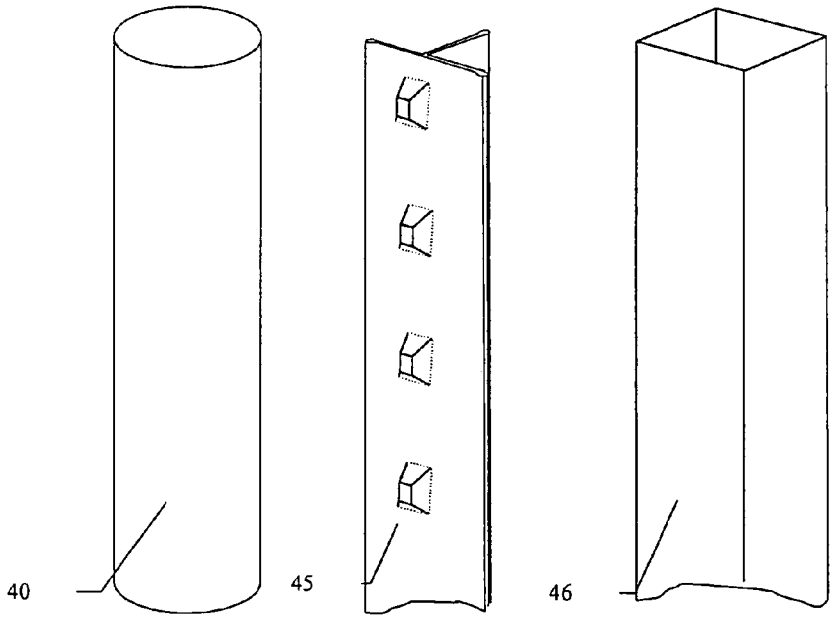
FIG. 8(f) Prior Art
FIG. 8(g) Prior Art
FIG. 8(h) Prior Art

FENCE ASSEMBLY AND RELATED METHODS

FIELD OF THE INVENTION

The present invention relates to a modular type fence system, and apparatus and methods for assembling components of the system. It preferably includes one or more retaining elements for assembling one or more fence panels and associated posts, and provides for (among other things) improved strength-to-weight characteristics, ease of installation and removal, and efficient handling and storage of the components and the fence system.

INCORPORATION BY REFERENCE

The contents of each U.S. patent or other reference, if any, cited in this application, are hereby incorporated by reference.

BACKGROUND

Temporary fence is increasingly becoming a fixture around construction sites and special events for safety, security, crowd control, or simply to restrict access. Temporary fences are constructed in numerous ways and from a variety of materials. Most commonly these barriers are constructed of posts driven into the ground, with rolled chain link mesh or plastic safety netting attached to the posts with wires or clips. Increasingly, however, prefabricated fence panels are being used in temporary applications due to the speed of installation and/or removal, longevity, enhanced security, and the flexibility of being able to easily remove and then re-install one or more panels to allow for short term access.

These prefabricated temporary fence panels are largely comprised of panels constructed by attaching chain link mesh to a tubular framework. While these panels have several advantages as previously mentioned, their bulkiness typically creates a handling and storage problem that is significant, particularly when one considers the number of times these reusable fence sections are handled, stored, reused, etc.

In one prior art fence assembly, for example, panels typically have rings permanently attached to vertical framing members. During installation, a post is placed through the rings of adjacent panels and then into a stand or driven into the ground. The post supports the panels in an upright position as well as connecting them together to form a structure.

Other prior art panels have been attached to the post or directly to each other through the use of a bolt-on clamping bracket. Arguably, this kind of connection may be more secure, however, the time necessary to bolt the panels to the post make the assembly and disassembly process relatively time consuming. In addition, although the typically large attachment rings on the framework of these panels are efficient for installation purposes, those large rings exacerbate the problems of handling and storage, such as by spacing the panels from each other when stacked in storage.

Rather than chain link, panels may also be constructed of welded wire mesh attached to the tubular framework. In some cases, the welded wire mesh has one or more horizontal bends in the surface to stiffen the mesh instead of the horizontal tubular framing members. This alternative design, combining stiffening horizontal bends with vertical tubular framing members, may reduce some of the material cost but has little or no impact on the handling and storage problem mentioned above, given that the stacking thickness of the panel is still typically determined by the dimensions of the tubular members.

Although theoretically these panels of welded wire mesh with horizontal stiffening bends and/or horizontal framing members may be fixed directly to the posts by a bolted clamping bracket or similar means, the additional labor for installing these clamps and the requisite precision in spacing the posts has not made this a viable option for temporary fence applications.

SUMMARY OF THE INVENTION

One embodiment of the invention describes a fence assembly that preferably uses known welded wire mesh panels, a standard post, and a retaining element or bracket that provides for simple attachment of the assembly at the time of installation without the use of bolt-on clamping style brackets. The brackets of the present invention affix the mesh to the post in a fashion that provides for vertical structural rigidity without the use of a separate vertical framing member or members, resulting in significant material savings. Preferably, this same bracket can be connect one or more adjacent panels without the use of a separate framing member or additional post. Furthermore, this embodiment of the fence assembly of the invention affords relatively broad tolerances that allow for efficient installation under a variety of circumstances.

A wide variety of embodiments of the invention enable a fixed attachment of one or more panels to one or more posts, without the use of labor intensive bolt-on clamping brackets. This fixed attachment permits lighter gauge wire to be used in the mesh, lowering the overall cost of the system.

Certain embodiments allow the post or posts to serve a dual purpose, thereby eliminating the need for separate vertical framing members or for permanently attached mounting rings on the panel. As a consequence, and among other things, handling and storage are made more efficient, a significant material savings is realized, and labor to assemble the panels is substantially reduced.

BRIEF DESCRIPTION OF THE DRAWINGS

FIG. 2(*b*) is a top view of the bracket of FIG. 2(*a*) connecting a post to a generally planar mesh panel.

FIG. 2(*c*) is a side view of the bracket and post connection of FIG. 2(*b*).

FIG. 2(*d*) is a front view of the connection of FIGS. 2(*b*)-(*c*).

FIG. 2(*e*) is similar to FIG. 2(*b*), but illustrates the bracket used with two generally planar mesh panels overlapped and connected together to the vertical post.

FIG. 3(*b*) further illustrates one of the many alternative ways to form an interference fit bracket.

FIGS. 3(*c*)-(*e*) illustrate the bracket of FIG. 3(*b*) in use from top, side and front views respectively.

FIGS. 4(*b*) and (*c*) illustrate how the bracket of FIG. 4(*a*) can allow for changes in the vertical direction or grade of the fence by stepping adjacent panels (FIG. 4(*b*)) or by altering the panel pitch (FIG. 4(*c*)).

FIGS. 5(*b*) and (*d*) illustrate side and front views of the embodiment shown in FIG. 5(*a*).

FIG. 5(*c*) illustrates a similar embodiment but with the post 40 connected to the opposite side of the panel rather than inserted through the stiffening bend 30 of the panel.

FIGS. 6(*b*)-(*d*) are similar to FIGS. 3(*c*)-(*e*) respectively, but illustrate the bracket of FIG. 6(*a*) as it may be assembled with two or more adjacent fence panels.

FIGS. 7(*b*)-(*d*) are similar to FIGS. 6(*b*)-(*d*), but show the bracket embodiment of FIG. 7(*a*) from a top, side, and front view respectively.

FIGS. 8(*a*)-(*h*) show some of the many alternative embodiments of a post component that may be used in accordance with the present invention. The posts are sized and shaped in a fashion that permits them to be placed vertically through the openings formed by the horizontal stiffening deformations in the generally planar mesh panel. FIG. 8(*a*) is a triangular or angle version of a fence post that has been notched in a fashion to receive one of the horizontal wires of the deformed stiffening portion of the mesh panel. FIG. 8(*b*) shows alternate placement and notching of the post. FIG. 8(*c*) shows a notched H shaped post. FIG. 8(*d*) shows a generally T shaped post with a notch. FIG. 8(*e*) illustrates a round post that has been notched in a fashion to receive one or more horizontal wires or to accommodate alternative positions of the panel. FIG. 8(*f*)-(*h*) illustrate prior art of various known posts such as round tubing, a studded tee post, and a square tube post, any of which may be used to practice the invention.

FIGS. 9(*b*)-(*d*) illustrate various views of the system of FIG. 9(*a*) in one of its many modes of use, with a notched V-shaped post such as shown in FIG. 8(*b*).

FIGS. 11(*b*) and (*c*) are side and front views of the embodiment of FIG. 11(*a*), and further illustrate the system using fence panels having one or more stiffening bends of a variety of shapes in the planar surface of the panel (illustrated as a trapezoid shape in FIGS. 11(*b*) and (*c*).

FIG. 12(*d*) is similar to FIG. 12(*b*), but illustrates still another alternative embodiment, in which the bracket of FIG. 12(*a*) is used with a studded tee post.

FIG. 13(*b*) illustrates a side view of the bracket of FIG. 13(*a*).

FIG. 13(*c*) shows a top view of the bracket of FIG. 13(*a*).

FIG. 13(*d*) shows the bracket in use with more than one panel.

FIG. 13(*e*) illustrates the bracket of FIG. 13(*a*) alternatively formed with an elongated engagement housing 178.

FIG. 13(*f*) illustrates the bracket similarly formed but having a substantially round post receiving pocket.

FIG. 13(*g*) illustrates an embodiment of the cross clipping bracket with a substantially square post receiving pocket.

DETAILED DESCRIPTION

Figure 1:
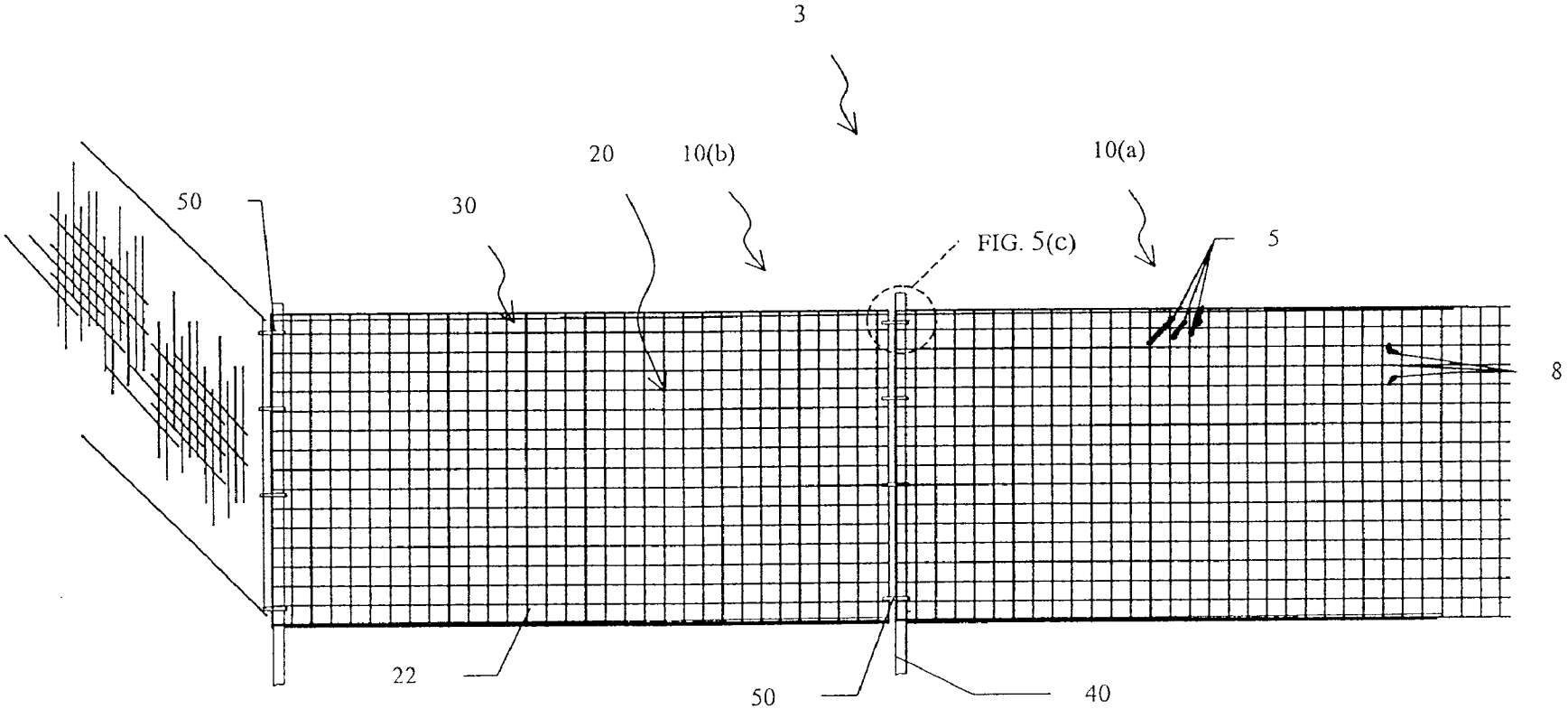
FIG. 1 illustrates an overview of a preferred embodiment of the fence assembly system.
Figure 2A:
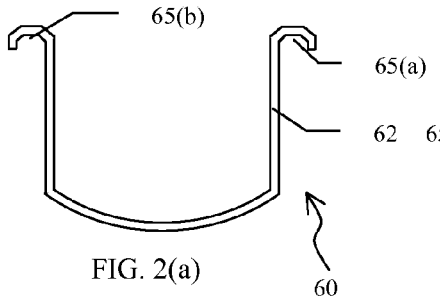
FIG. 2(*a*) illustrates one embodiment of a bracket in accordance with the invention.
Figure 2B:
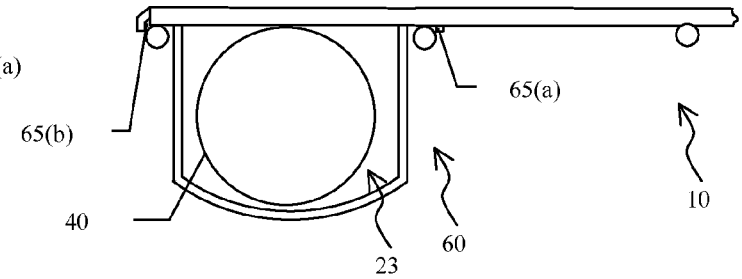
Figure 2C:
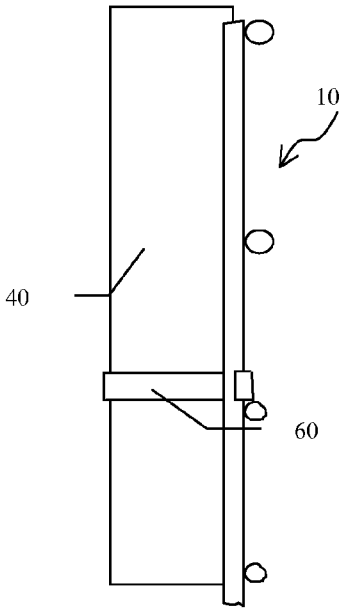
Figure 2D:
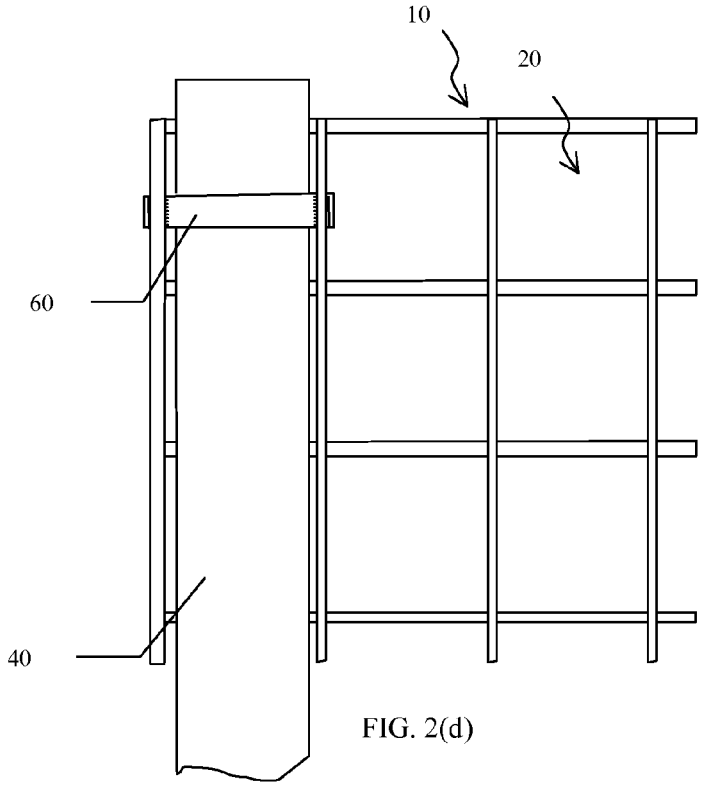
Figure 2E:
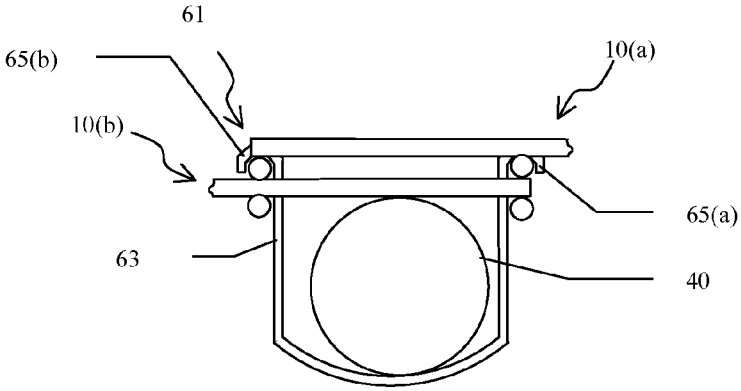
Figure 3A:
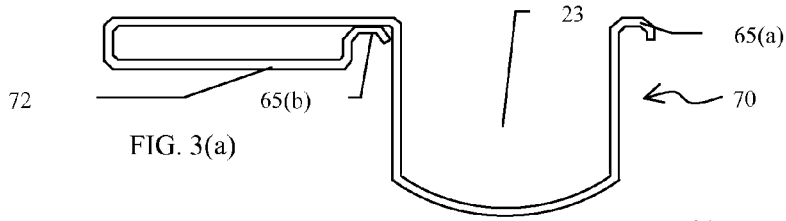
FIG. 3(*a*) illustrates one embodiment of the invention using an interference fit bracket that is capable (among other things) of connecting two or more generally planar mesh panels together in a linear fashion while also connecting those panels to a post.
Figure 3B:
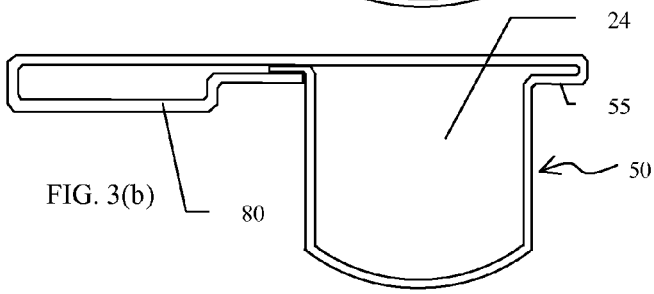
Figure 3C:
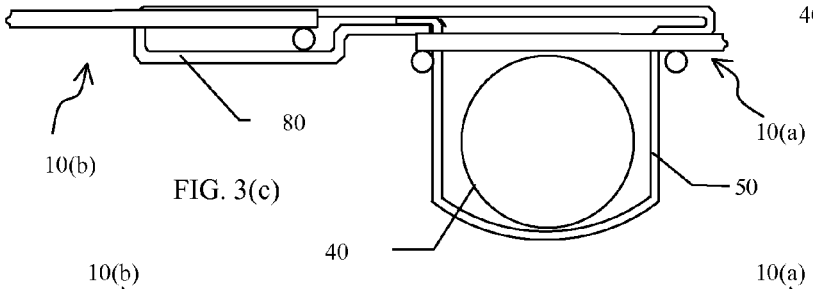
Figure 3D:
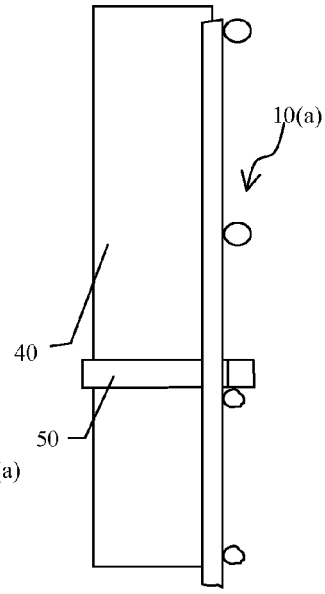
Figure 3E:
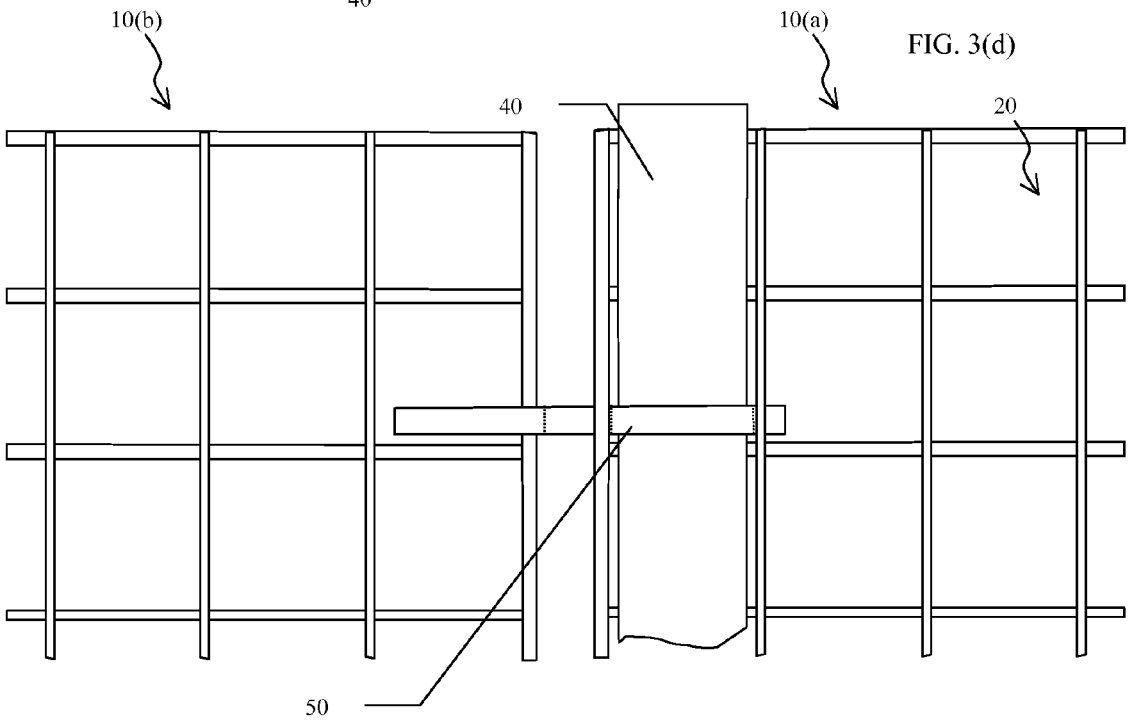

Embodiments of the present invention will now be described with references to the accompanying Figures. Generally, like reference numerals are intended to refer to like elements throughout. The terminology used in the description presented is not intended to be interpreted in any limited or restrictive manner, simply because it is being utilized in conjunction with a detailed description of certain embodiments of the invention. Furthermore, various embodiments of the invention (whether or not specifically described) may include novel features, no single one of which may be solely responsible for its desirable attributes or which may be essential to practicing the invention. The description herein and claims below are instead intended to describe and define the invention in a manner supporting the broadest scope of coverage to which the claims may be lawfully entitled.

General wire mesh or reticulated wire structure, material, fence panels, and methods of construction are well-known in the art. Accordingly, those general teachings and other various aspects of the fence panel fabrication process or method are only briefly discussed herein. Persons of ordinary skill in the art will understand that the invention can be practiced with any suitable materials and a variety of suitable fabrication methods, including ones other than metal (such as plastics) and ones other than welding (such as gluing or injection molding or the like). Certain metal wire types or other materials may require specialized joining methods. Likewise, as indicated herein, plastic wire panels having latitudinal and longitudinal or otherwise transverse wire sets may be prefabricated as a single integral piece, or as individual wire sets transversely positioned to each other and joined by heating or similar bonding methods.

As shown in FIG. 1, the fence assembly of the present invention 3 preferably includes one or more generally planar panels, generally indicated by reference number 10 and specifically by reference numbers 10(*a*), 10(*b*), . . . etc. For embodiments that include more than one panel, the panels can be joined together with one or more retaining elements or brackets 50.

As further shown in FIG. 1, a first set of generally parallel latitudinal spaced-apart wires 8 and a second set of generally parallel longitudinal spaced-apart wires 5 are preferably used to form a generally planar mesh area 20 within panel 10(*b*). Preferably, the latitudinal and longitudinal wires of each set 5, 8 are at right angles to each other and are periodically spaced an equal distance from other wires within the set. Persons of ordinary skill in the art will understand, however, that the invention can be practiced with wires spaced in other patterns and angles.

As used herein, the term "planar" is a broad term generally used in its ordinary meaning of "a surface at which the curvature is zero". The term "generally planar" is therefore a surface that "generally" has "zero" curvature (or is "generally" flat), and pertains to the preferred overall surface appearance of the fence panels, regardless of whether irregularities or bends form a portion of that overall surface appearance. For example, a woven reticulated or netlike wire mesh fence typically includes wires periodically bent to accommodate the fence's woven features. However, the overall surface appearance of such a fence is considered "generally planar" within the context of the present invention. Persons of ordinary skill in the art will understand that, in alternative embodiments, the invention can be practiced with other panels having other deformations, bends, and the like.

As best shown in FIG. 5(*b*), in at least one embodiment, the surface 22 of the generally planar panel 20 is preferably deformed to form at least one generally linear bend 30 substantially across the generally planar surface 22, such that the bend 30 is oriented in a substantially horizontal direction when the fence panel 10 is erected. The bend(s) 30 or other stiffening means, described herein, preferably impart structural stability to the fence panel 10 in at least the horizontal direction. This preferably obviates, or at least reduces, the need for secondary support such as a tubular frame on the panel.

Although persons of ordinary skill in the art will understand that aspects and other embodiments of the invention can be practiced with the addition of further tubular frame members (including, by way of example and not by way of limitation) one or more horizontal tubes "clipped" to the wire mesh using one or more clip elements described herein or other attachment means), a simple embodiment such as FIGS. 2 and/or 5 can permit easy erection and disassembly of temporary barriers without the added weight and bulk of additional tubes or other frame/support members.

In a preferred embodiment, one or more wires having a smaller gauge (larger diameter) than most or all of the rest of the fence panel forms at least a section of at least one stiffening portion 30 formed within the fence panel 10. Persons of ordinary skill in the art will understand that the exact number and spacing/location of the latitudinal, longitudinal, and alternative wire gauges can be in any position and configuration, and may vary depending on various manufacturing and application requirements. Furthermore, the exact angle of transverse and intersection between the first set of wires and the second set of wires 5, 8 as well as the gauge and periodic spacing of wires within each set 5, 8 will depend on various factors, including, among other things, the fence panel's intended residential or commercial or other application. For example, in the embodiments shown in the attached drawings, at least some of the spaced-apart wires 5, 8 traverse one another at an approximate right angle.

The panel or panels 10 are preferably connected to one or more posts 40, which preferably are periodically spaced in an appropriate relationship along the length of the panels. Depending on the application and the specific terrain and/or configuration of the barrier and other factors, the posts can be selectively positioned to provide greater support in some areas than in others.

Although a wide variety of attachment means can be used, preferably one or more brackets such as bracket 50 attach the panel 10 to the post 40. In the preferred embodiment, the attachment and overall assembly utilizes the post 40 to provide vertical structural rigidity for the fence panel(s) 10, as well as holding the panel(s) in a desired generally vertical position. A wide variety of embodiments of the bracket 50 can serve to secure the panel 10 to the post 40, and many can also connect the panels 10 together to form a continuous structure.

Persons skilled in the art will recognize that there are many benefits of the present invention. These include the efficiency and cost savings available in the installation process, and can be practiced, by way of example, by various combinations of the following steps: (1st) positioning a first panel 10(*a*), (2nd) positioning a second panel 10(*b*) relative to the first panel 10(*a*), (3rd) connecting the two panels 10(*a*), 10(*b*) together with a least one bracket 50 as described herein, (4th) inserting a post 40 through the bracket(s) 50 and a horizontal stiffening portion(s) 30 formed within at least one of the panel(s) thereby securing the panels 10(*a*), 10(*b*) together.

By necessity and for convenience, each of the foregoing exemplary process or method steps is described in a particular sequence. However, the invention can include methods that are subsets of the foregoing steps, and/or may involve those steps in a different order. Furthermore, the steps involved in any particular embodiment of the inventive method can be affected by the continuation, or interruption of other step(s) that were previously started. In other words, the precise steps within the various methods of the invention can be dependent on a number of factors, including the initial starting condition of the fence panel or any portion of the described fence panel, terrain or installation anomalies or the system's desired final condition or state.

FIG. 2(*a*) illustrates a bracket 60 embodiment of the invention formed in a fashion that can be inserted through the spaced apart wires 5, 8 of a fence panel 10 and connected by hook shaped engagement surfaces 65(*a*), 65(*b*) to two or more of the longitudinal wires of the planar mesh surface 20. In a preferred embodiment, the fence assembly 3 includes a first panel 10 having a generally planar surface of spaced apart wires 20, at least one retaining bracket 60, and a vertical post 40. The post 40 is retained generally between the panel 10 and the bracket 60 by attachment of the bracket 60 to the spaced apart wires 20. As explained herein, preferably the desired engagement of the retaining bracket 60 and the panel 10 and the post 40 is accomplished without the use of a bolt, screw or similar connecting device, so as to simplify the installation and disassembly of the system.

The bracket 60 preferably includes a first pocket 23 configured to receive the vertical post 40. The first pocket 23 is formed, at least in part, by a first pair of generally parallel spaced apart sides 62. Each side 62 preferably includes outwardly extending engagement surfaces 65(*a*), 65(*b*). As shown in FIG. 2(*a*), in one embodiment, the outwardly extending engagement surfaces 65(*a*), 65(*b*) are generally hook shaped. Preferably, the sides 62 are capable of being flexed about the vertical post 40 to permit attachment of the surfaces 65(*a*), 65(*b*) to corresponding spaced apart wires 20 of the first panel 10.

Compressing the sides 62 of the bracket 60 permits the bracket 60 to be inserted from either side of the panel 10. FIG. 2(*b*) illustrates a vertical view of the bracket 60 inserted through the generally planar panel 10 forming a pocket 23 that can receive a post 40. FIG. 2(*c*) is a side view illustrating the reinforcing effect of using the bracket 60 to trap the mesh panel 10 securely against the post 40. By periodically placing brackets 60 over the length of the post 40 any vertical load on the mesh panel is largely carried by the compressive strength of the vertical wires of the mesh panel 10. FIG. 2(*d*) illustrates a front view of the embodiment.

FIG. 2(*e*) illustrates one of the many alternative embodiments of the bracket 60, having sides 63 slightly longer than the previously described bracket 60 to permit the bracket 61 to secure two overlapping panels 10(*a*), 10(*b*) to a single post 40 forming a continuous linear structure. In this embodiment, the fence assembly 3 further includes a second panel 10 having a generally planar surface of spaced apart wires. As shown, a portion of the spaced apart wires of each of the first panel 10(*a*) and the second panel 10(*b*) overlap. The bracket sides 63, as mentioned above, are configured to further permit attachment of the engagement surfaces 65(*a*), 65(*b*) to corresponding overlapped spaced apart wires of one of the first panel 10(*a*) and the second panel 10(*b*) to facilitate attachment of the first panel 10(*a*) and the second panel 10(*b*) to the vertical post 40.

FIG. 3(*a*) is another of the many alternative bracket embodiments 70 having a similar open pocket 23 design with hook 65(*a*), 65(*b*) style engagement surfaces. The bracket includes a first engagement housing 72 formed along one of the sides 62 for use in securing one or more of the vertical wires of an adjacent panel by flexing the housing 80 open to engage the first wire of the second panel prior to installing a post 40. Although the housing 72 is formed along the left side of the bracket in FIG. 3(*a*), persons of ordinary skill in the art will understand that the housing can be formed along any of the generally parallel spaced apart sides for use in securing one or more of the vertical wires of an adjacent panel.

FIG. 3(*b*) illustrates yet another bracket embodiment 50 of the system. Similar to the housing used in FIG. 3(*a*), bracket 50 incorporates an engagement housing 80 to secure the adjacent panel. However, instead of the open style pocket 23 used in FIG. 3(*a*), the bracket of FIG. 3(*b*) utilizes a closed style pocket 24. Therefore, although the housing 80 is formed along one side of the bracket in FIG. 3(*a*), the housing 80 is connected to the opposite side of the bracket in FIG. 3(*b*) via a strip of metal along the top of the bracket which forms the closed style pocket 24. The bracket 50 is preferably installed by flexing the housing 80 around a spaced apart wire of one of the panels 10. The closed style pocket 24 is then preferably inserted, pushed, or similarly positioned through the spaced apart wires of the other panel 10 to provide a receiving pocket 24 for the post 40 that secures the post 40 to the panel 10.

A tab 55 or similarly formed element of the bracket 50 can be provided to restrict the rotational movement of the bracket 50. FIG. 3(*c*) illustrates a top view of the bracket 50 connecting two panels 10(*a*), 10(*b*) to the post 40. FIGS. 3(*d*) and (*e*) are side and front views of the same installation of the invention. While the illustrations generally reflect a design made of a rectangular strip of material, persons of ordinary skill in the art will recognize that the connecting bracket may be made in a variety of shapes and dimensions, and from any suitable material or materials (the latter would include, without limitation, materials such as formed wire, molded materials, cast materials, etc.). Among other things, the material can be selected based on its anticipated exposure to the elements (rain, snow, sun, wind, etc.) as well as its material characteristics (flexibility, material memory, etc.).

Figure 4A:
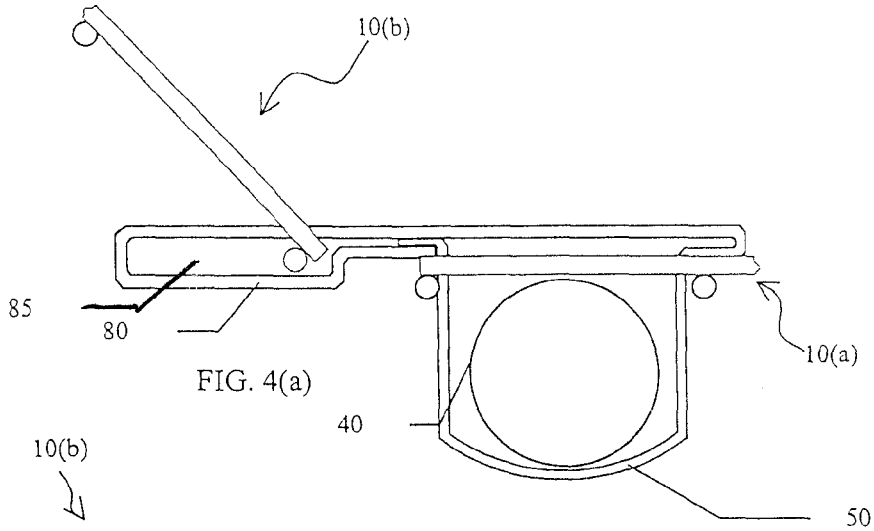
FIG. 4(*a*) illustrates the bracket of FIG. 3(*b*) showing how the bracket accommodates a change in the connectivity direction of the fence/panels.
Figure 4B:
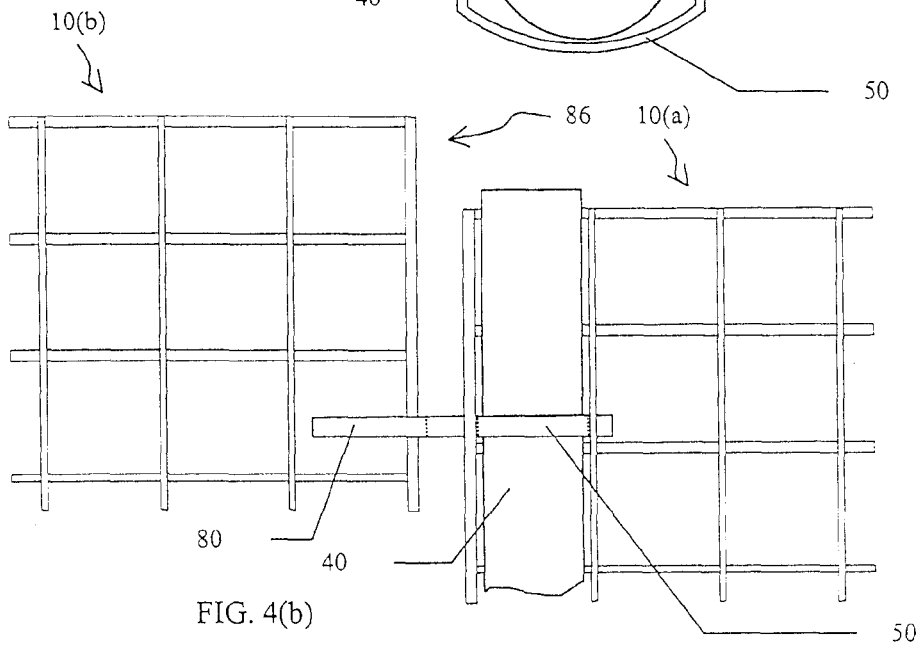
Figure 4C:
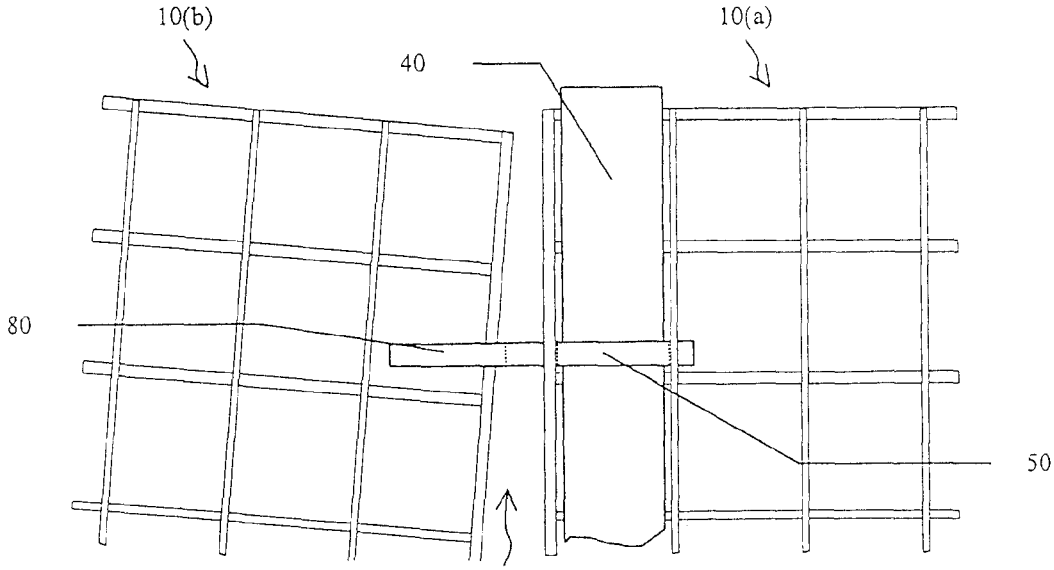
Figure 5A:
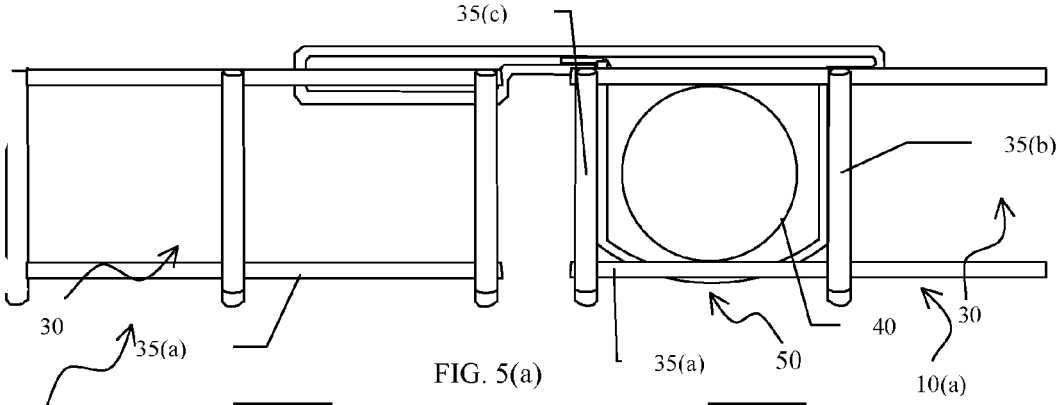
FIG. 5(*a*) shows a top view of a fence system using the bracket of FIG. 3(*b*) with generally planar fence panels that include at least one horizontal stiffening portion or bend 30 (see 35(*a*) and 35(*b*)) in the body of the panel. The size and shape of the stiffening portions can allow for the generally vertical post 40 to be inserted in a generally vertical manner.
Figure 5B:
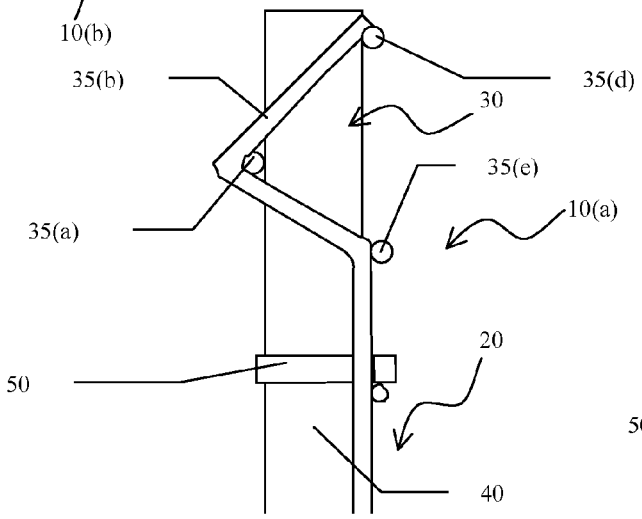
Figure 5C:
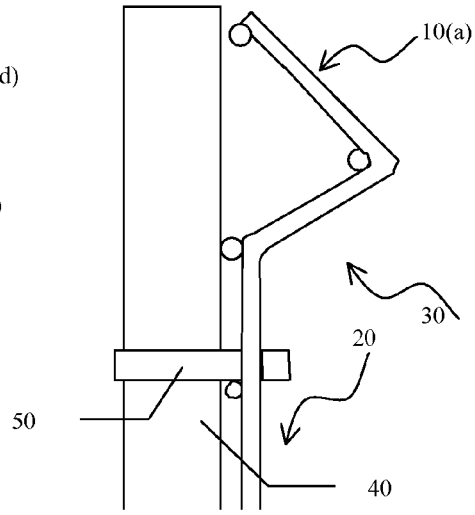
Figure 5D:
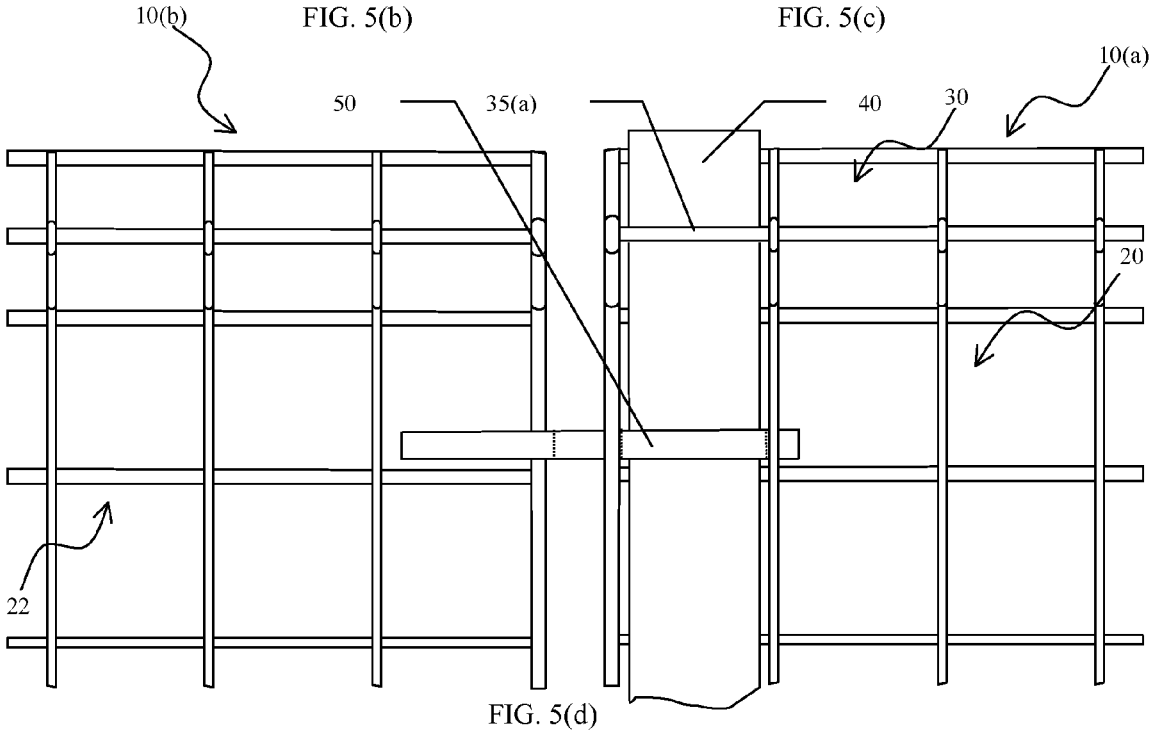
Figure 6A:
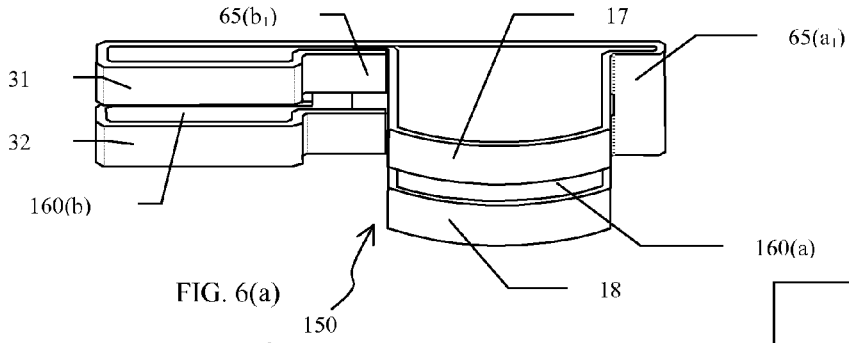
FIG. 6(*a*) is a perspective view showing another of the many alternative embodiments of the bracket of FIG. 3(*b*), incorporating a horizontal slot in portions of the bracket. Among other things, the slot permits the bracket to be installed around one of the horizontal wires of the panel as shown in FIGS. 6(*b*)-(*d*).
Figure 6B:
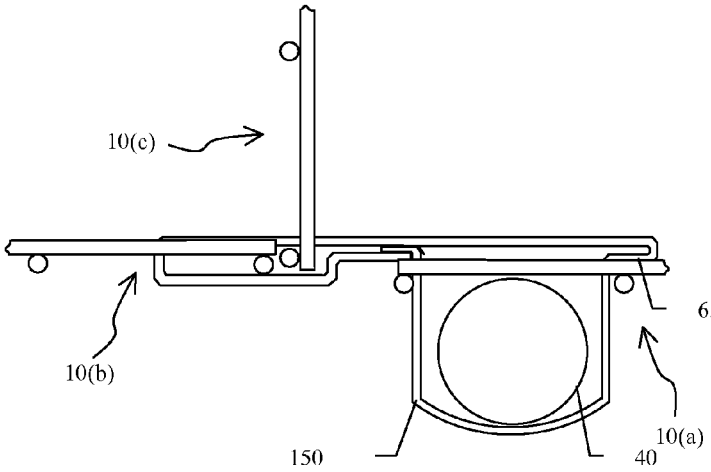
Figure 6C:
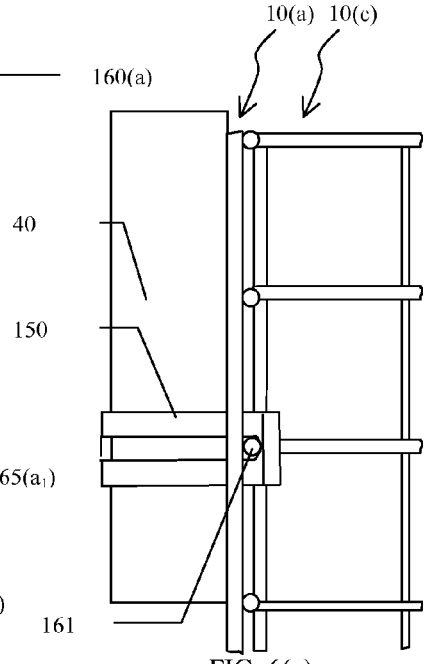
Figure 6D:
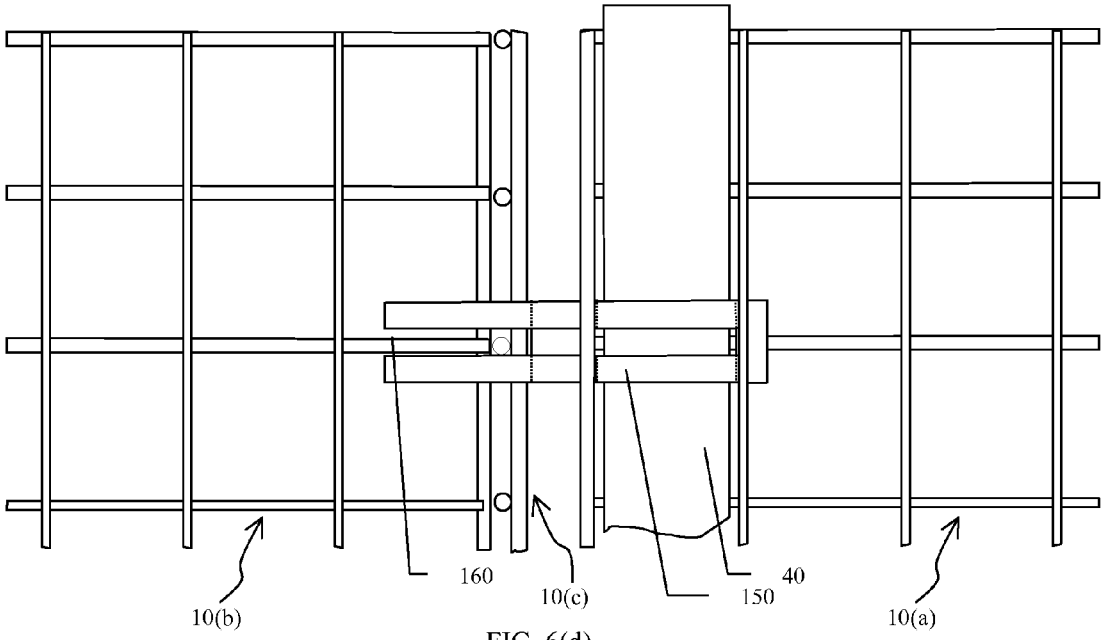
Figure 7A:
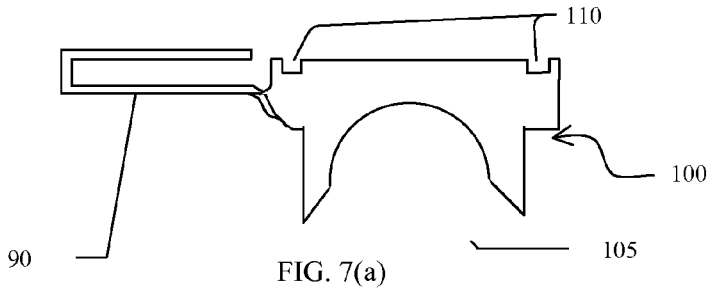
FIG. 7(*a*) is yet another of the many alternative bracket embodiments, which can be inserted and twisted into position, creating a friction and/or interference connection to prevent the bracket and/or panel from sliding down the post (due to the weight of the panel or bracket, or other load on the fence/assembly). Among other things, this embodiment can be readily used to space panels upwardly from the ground or similar surface.
Figure 7B:
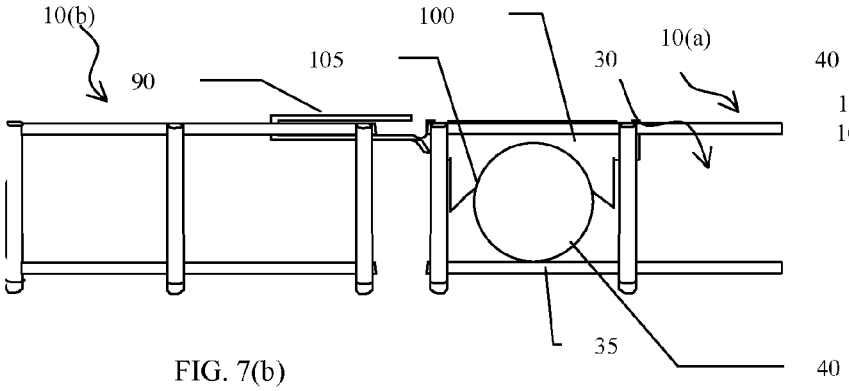
Figure 7C:
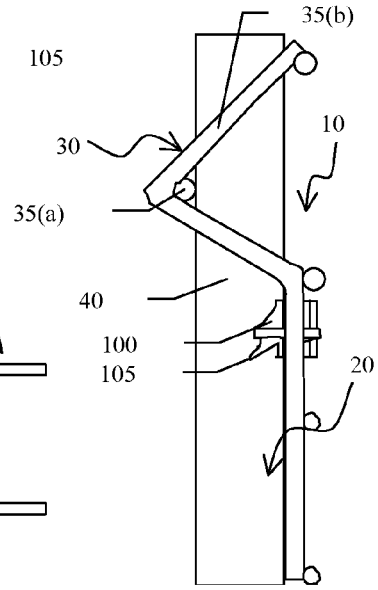
Figure 7D:
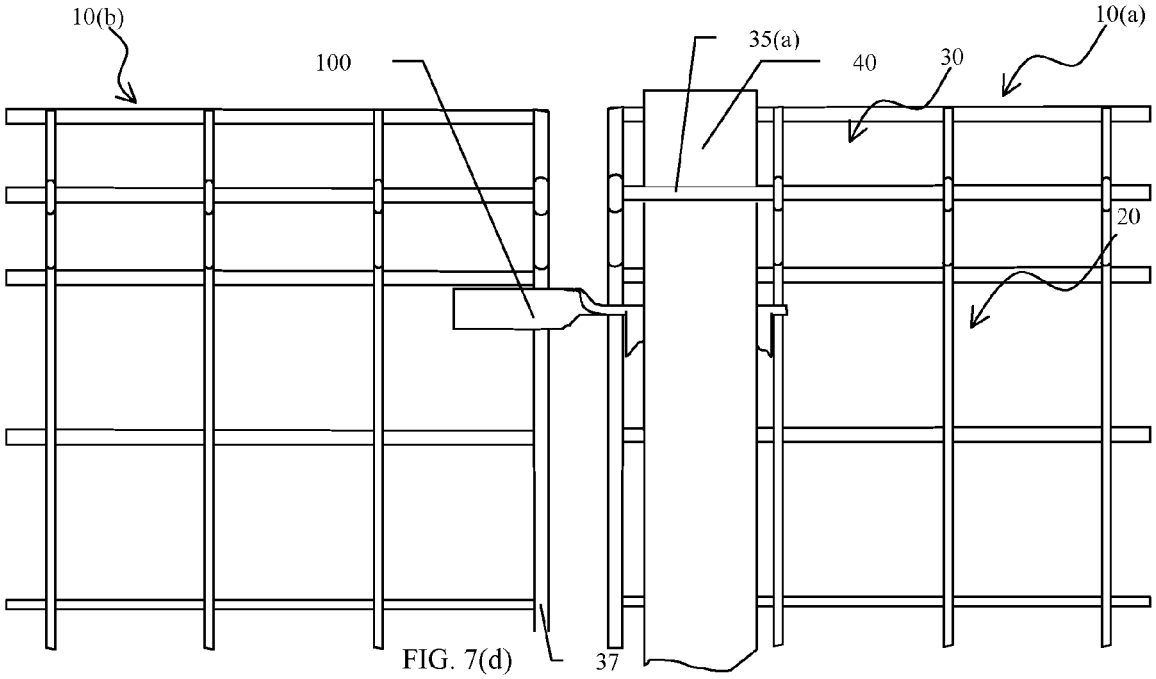
Figure 9A:
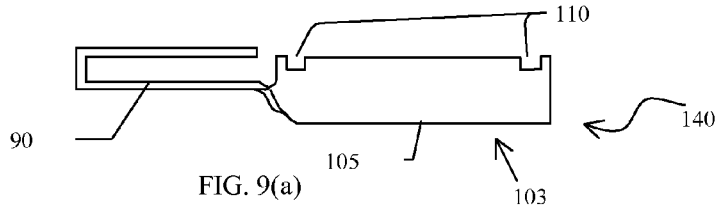
FIG. 9(*a*) shows still another of the many alternative embodiments of the invention, using a bracket that (when twisted into the position shown in FIGS. 9(*b*)-(*d*)) both connects the panels together and locks one or more of the horizontal wires of the mesh panel into the notches of the post.
Figure 9B:
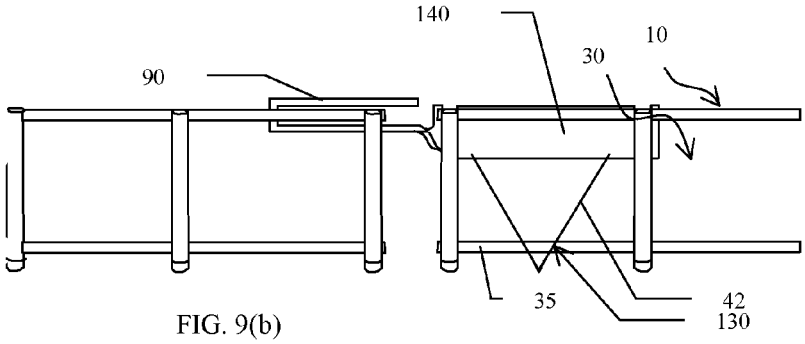
Figure 9C:
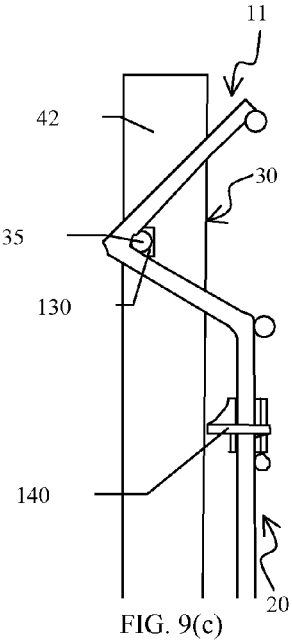
Figure 9D:
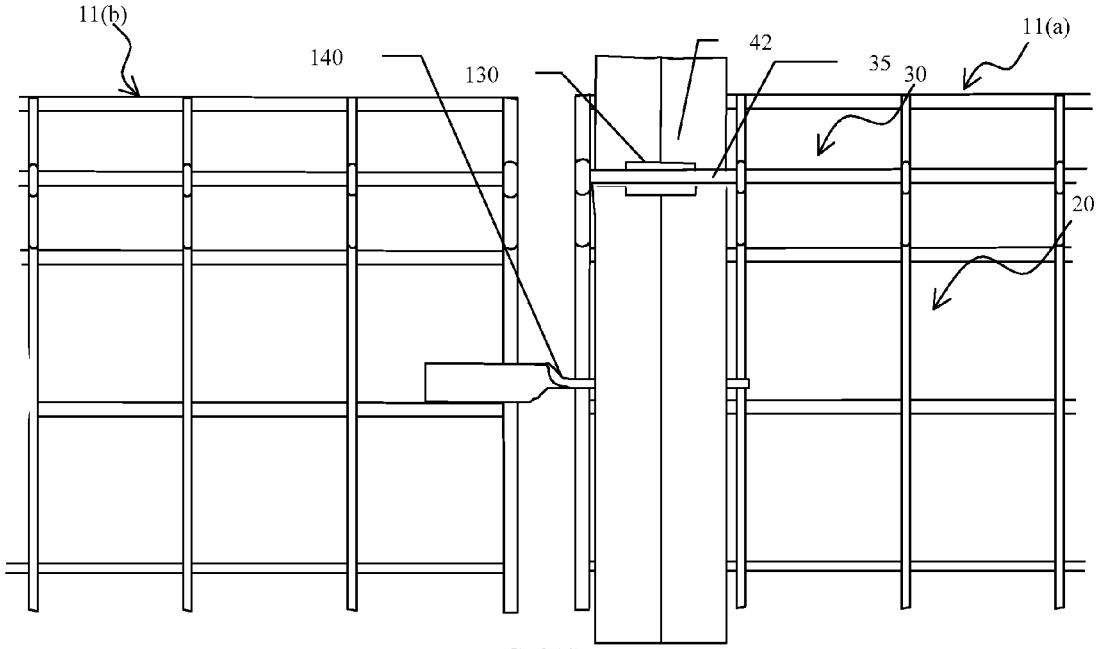

FIG. 4(*a*) illustrates a top view of a bracket 50 connecting a first panel 10(*a*) to a post 40. A second panel 10(*b*) is connected to the first panel 10(*a*) by securing the second panel 10(*b*) within the engagement housing 80. FIG. 4(*a*) illustrates how the size and shape of the opening 85 within the engagement housing 80 can be configured to permit the second panel 10 to be positioned in a non-linear position to the first panel 10(*a*). Depending on the intended application the size and shape of the engagement housing 80 can be altered to permit limited movement in one direction while allowing generous tolerances in other directions. These generous tolerances can allow for field adjustment in the placement and/or pitch of panel 10(*b*) relative to 10(*a*) simplifying the installation of the system. FIG. 4(*b*) illustrates how the same installation can be easily modified based on alternative positioning of the bracket 50 to permit stepped placement 86 of adjacent panels 10. Additionally (and as illustrated in FIG. 4(*c*)), a generous tolerance in the length of the opening 85 of the engagement housing 80 can permit grade changes 87 from panel 10(*a*) to panel 10(*b*,) yet the comparatively tight tolerances of the width of the opening 85 can still provide for solid attachment in the primary loaded plane of the structure.

FIGS. 5(*a*)-(*d*) illustrate top, side and front views of an installation of the fence assembly using bracket 50 and post 40 together with panels 10(*a*), 10(*b*) having one or more generally linear horizontally formed stiffening portions 30 which are formed in a manner to place one or more spaced apart wires 35(*a*), 35(*b*), 35(*c*) outside the generally planar surface 22 of the panels 10(*a*) and/or 10(*b*). The stiffening portion 30 of the panel in this embodiment of the invention is formed in a shape and dimension that can allow the post 40 of the system to pass between a portion of the spaced apart wires 35(*a*)-(*e*) providing another connecting point (similar to the closed style pocket 24 of FIG. 3(*c*)) between the post 40 and the panel 10(*a*). FIG. 5(*c*) illustrates an embodiment in which alternatively the post 40 is be placed on the side of the panels 10 opposite the horizontal stiffening portion 30 connecting through one or more brackets 50 to form the structure.

FIG. 6(*a*) is a perspective view of another bracket embodiment 150 which further adds cut out areas 160(*a*), 160(*b*) within the wall of the bracket 150 permitting the bracket 150 to be installed around one of the horizontal wires 161 of each of the panels, which can further restrict the movement of the bracket 150 and therefore movement of the panels within the structure. In this embodiment, the bracket 150 includes a first pocket 17 and a second pocket 18 configured to receive the vertical post 40. The first and second pockets 17, 18 are spaced apart from each other and formed along the same side of the bracket 150. The first and second pockets 17, 18 are formed at least in part by a first pair and second pair of generally parallel sides, respectively. The sides are connected to the engagement surfaces 65($a_1$), 65($b_1$) and spaced apart from each other. The bracket 150 also includes a first housing 31 and a second housing 32 spaced apart from each other and formed along the other side of the bracket 150. The spaced apart housings 31, 32 are capable of receiving a horizontally spaced apart wire of one panel, and the spaced apart pockets 17, 18 are capable of receiving a horizontally spaced apart wire of another panel to facilitate attachment of the panels 10 to the vertical post 40.

FIG. 6(*b*) illustrates a top view of the bracket 150 installed with two panels 10(*a*)-(*b*) and a post 40. FIGS. 6(*c*)-(*d*) illustrate side and front views of the same installation.

FIG. 7(*a*) illustrates another alternative embodiment of a bracket 100 having a twist-in interference type fit characterized by friction, interlock or compression attachment between elements. The bracket 100 includes a body portion 103 having alignment notches 110 positioned on one side that engage two or more of the vertical wires of a first panel 10(*a*), an engagement edge 105 positioned on the opposite side of the body portion 103, which can be shaped to generally conform to the cross sectional shape of the post 40, and a receiving housing 90 extending from the body portion 103 that engages a second panel 10(*b*) to connect the first panel 10(*a*) to the second panel 10(*b*).

FIGS. 7(*b*), (*c*) and (*d*) illustrate top, side and front views of one embodiment of the installed invention. As mentioned above, installation may be done in the following sequence (and disassembly in the opposite sequence): (1) positioning the first panel 10(*a*); (2) sliding the post 40 through the openings created by the wires 35(*a*)-(*c*) forming the horizontal stiffening section 30 of the first panel 10(*a*); (3) twisting the bracket 100 into position to engage the engagement edge 105 against the post 40 and press the post against the horizontal wires 35(*a*)-(*c*) of the stiffing section 30 in a friction or compression fit arrangement; (4) slipping the second panel 10(*b*) into the engagement housing 90, securing the bracket 100 in an engaged position, and vertically securing the first edge 37 of the second panel 10(*b*). Other methods and sequences of such steps can also be used to practice and benefit from the invention.

FIGS. 8(*a*) and (*b*) illustrate posts 42, 47 of the invention having a generally angular cross section. FIG. 8(*c*) shows a generally "H" shaped post 43. FIG. 8(*d*) illustrates a "T" shaped post 44 and FIG. 8(*e*) shows a round shaped post 41 of the invention. Accordingly, FIGS. 8(*a*)-(*e*) illustrate some of the many and various post shapes that can be used as part of the invention. Each example including one or more notches or indentations formed in the post for receiving the horizontal spaced-apart wires of a panel 10. Among the many variations, the notches can be either angular 120, straight 125, 130, 135 or arcuate 145 in their shape and positioning. Additionally known posts can be used with various embodiments of the system. FIG. 8(*f*) shows a round tubing post 40, similar to the one shown in FIGS. 2-7(*d*), FIG. 8(*g*) a studded Tee post 45, and FIG. 8(*h*) a square tubular post 46. Persons of ordinary skill in the art will recognize that the illustrations of FIGS. 8(*a*)-(*h*) are not intended to be all inclusive of the various combinations of cross section shapes, notch shapes or positioning or combinations thereof.

FIG. 9(*a*) is an alternative embodiment of a bracket 140 of the invention incorporating a twist-in interference fit design. Similarly to FIG. 7(*a*), this embodiment has two or more alignment notches 110 which engage the vertical spaced apart wires of the panel when rotated into position. As shown in FIG. 9(*b*) the opposite edge of the bracket 140 locks the non-planar horizontal wire(s) 35 of the stiffening portion 30 into the notches 130 placed in the post 42 preventing any vertical movement of the panel. Side and front installed views of this embodiment of the invention are illustrated in FIGS. 9(*c*) and (*d*). The installation process is similar to that described above for FIGS. 7(*a*)-(*d*).

Figure 10A:
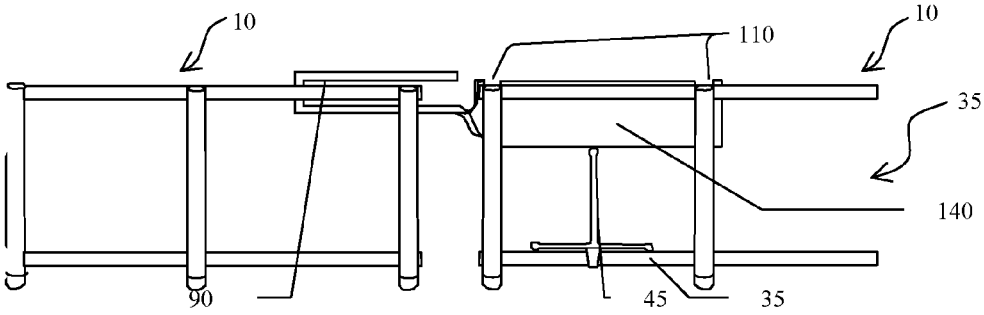
FIGS. 10(*a*)-(*c*) show the bracket of FIG. 9(*a*) formed in a fashion that can be used with a standard tee post such as shown in FIG. 8(*g*).
Figure 10B:
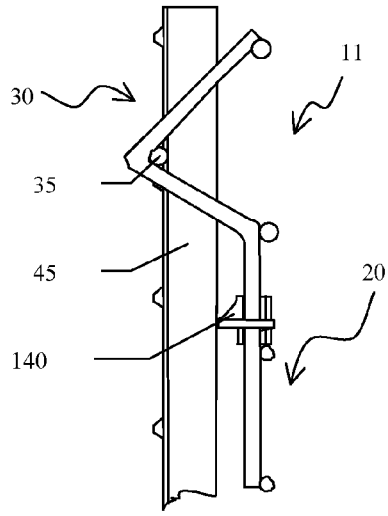
Figure 10C:
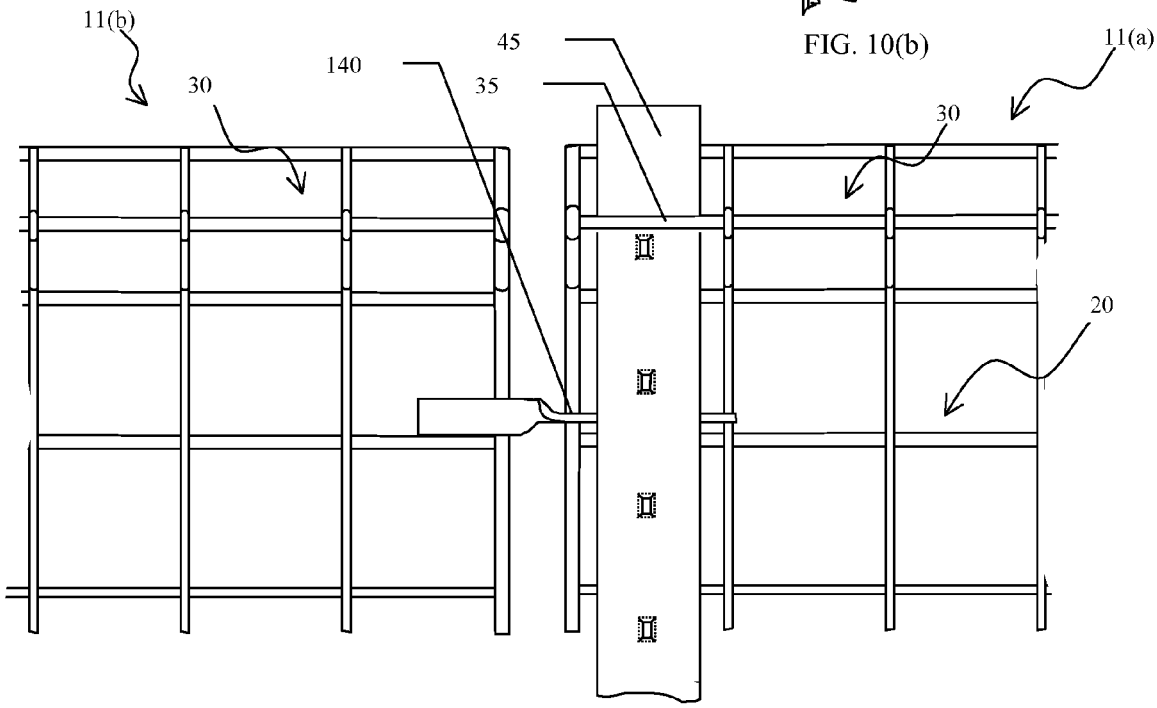

FIGS. 10(*a*) (*b*) and (*c*) illustrate the bracket 140 of FIG. 9(*a*) used in conjunction with a tee post 45 of prior art (previously illustrated in FIG. 8(*g*)).

Figure 11A:
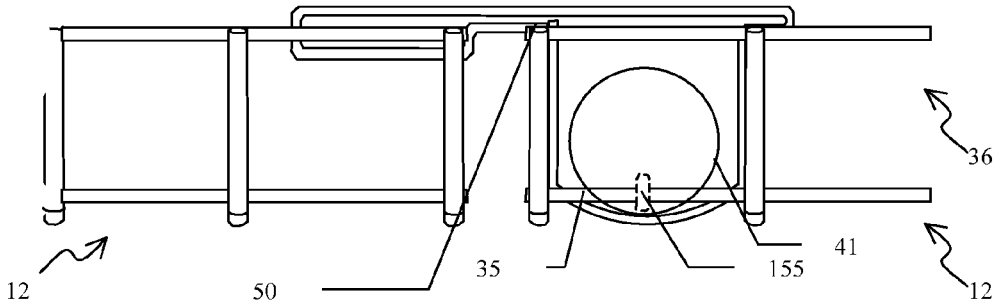
FIG. 11(*a*) shows a connecting bracket and notched post (such as shown in FIG. 8(*e*)) embodiment of the invention, further illustrating how one or more horizontal wires of the panel can be held in a desired relationship with the post by using a wire pin 155.
Figure 11B:
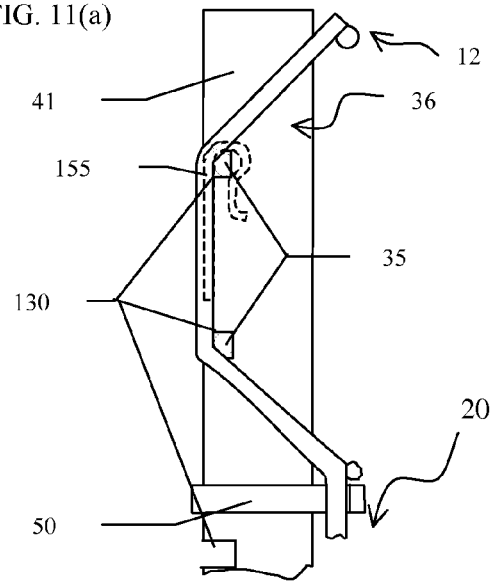
Figure 11C:
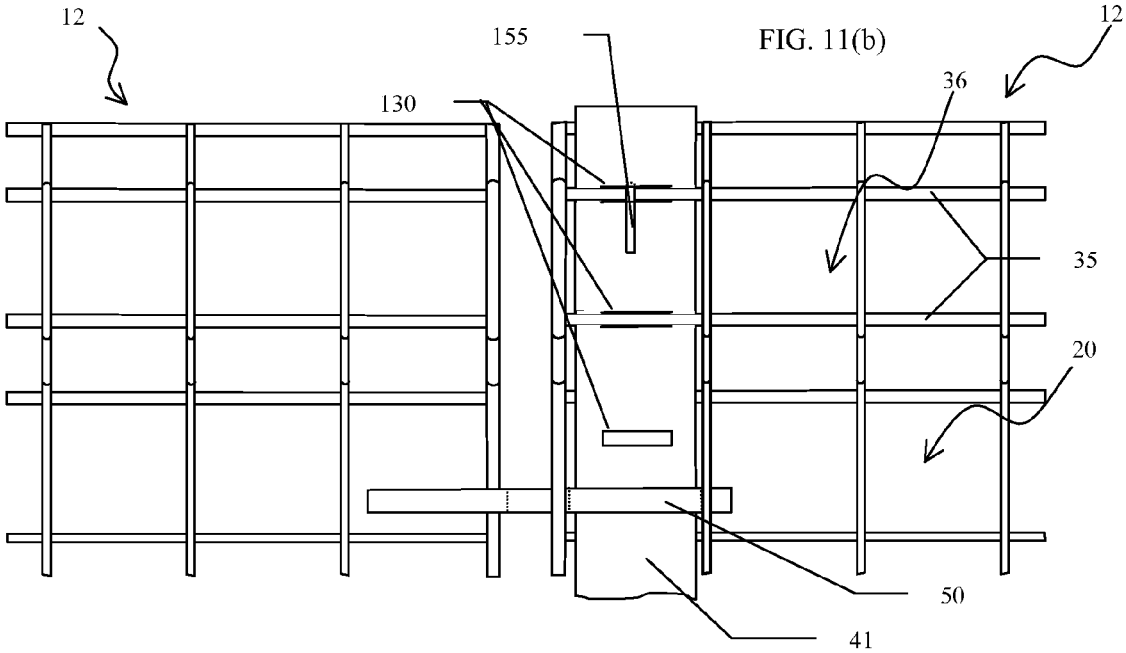
Figure 12A:
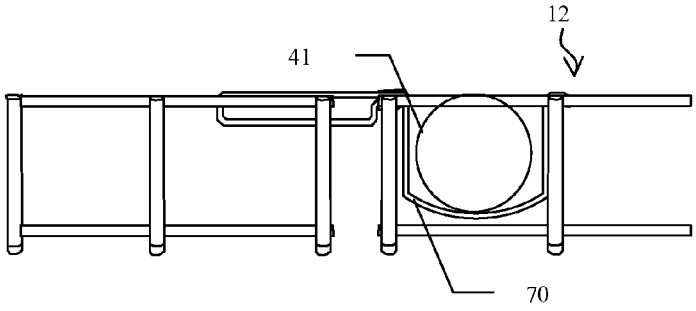
FIGS. 12(*a*)-(*c*) are top, side, and front elevation views, respectively, of yet another embodiment of the invention, showing the bracket embodiment of FIG. 3(*a*), inserted after the post and panel are installed, to pull the horizontal wire of the fence panel's planar section (rather than wires in the stiffening portion) into the notches of the post. The spring or flex qualities of the embodiment of the bracket preferably allow it to be deformed slightly for insertion.
Figure 12B:
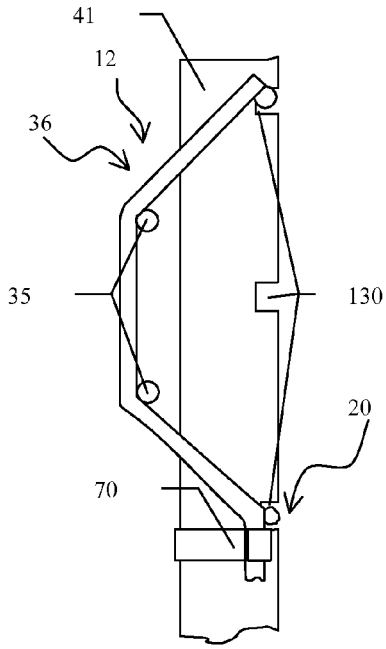
Figure 12C:
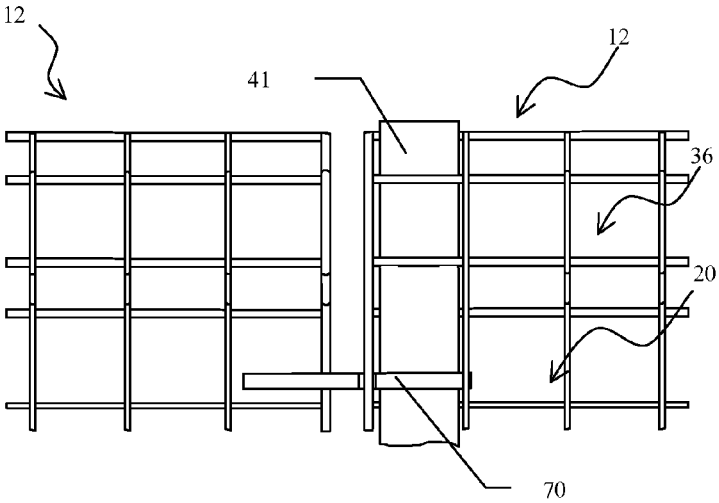
Figure 12D:
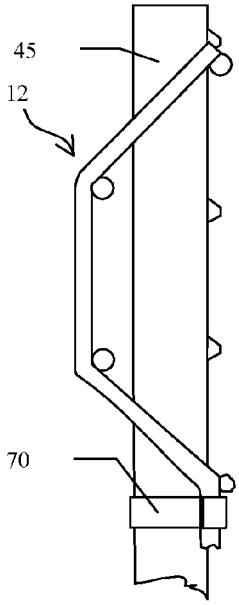
Figure 13A:
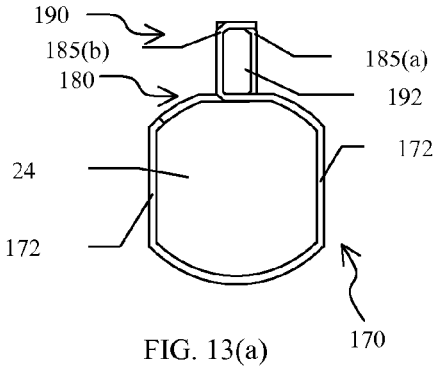
FIG. 13(*a*) illustrates yet another of the alternate bracket embodiments of the invention using a bracket that has a cross clipping action in which the insertion of the post locks the engagement chamber 190 of the bracket to the panel(s).
Figure 13B:
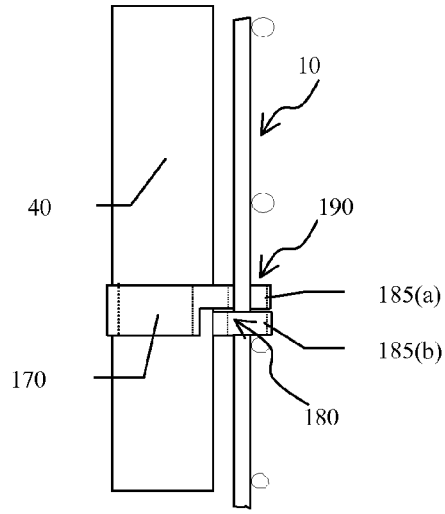
Figure 13C:
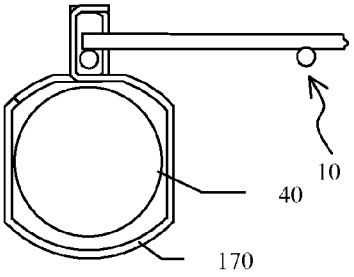
Figure 13D:
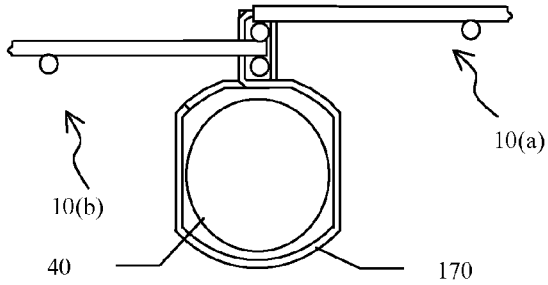
Figure 13E:
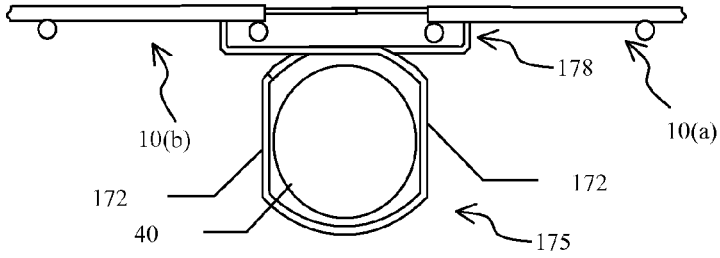
Figure 13F:
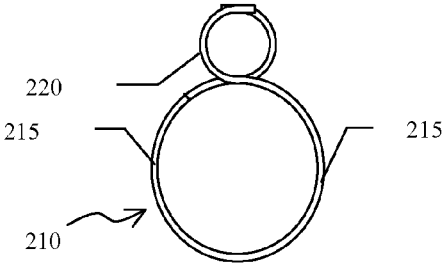
Figure 13G:
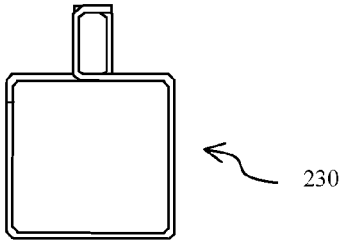
Figure 14A:
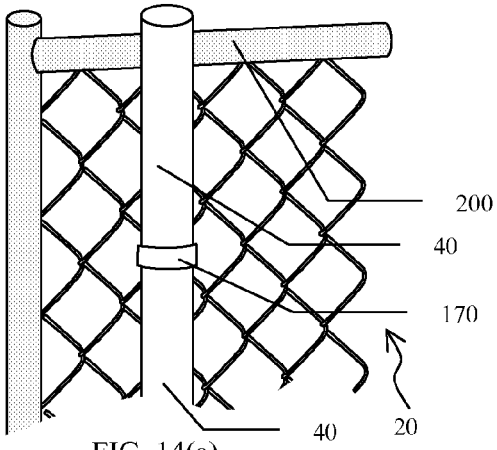
FIGS. 14(*a*)-(*f*) illustrate that the invention may be practiced with alternate types of fence panels using the bracket of FIG. 13(*a*) in its various embodiments to attach chain link panels or ornamental picket panels as two examples of the many potential embodiments.
Figure 14B:
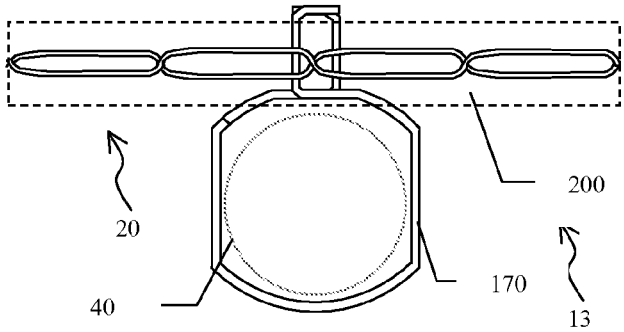
Figure 14C:
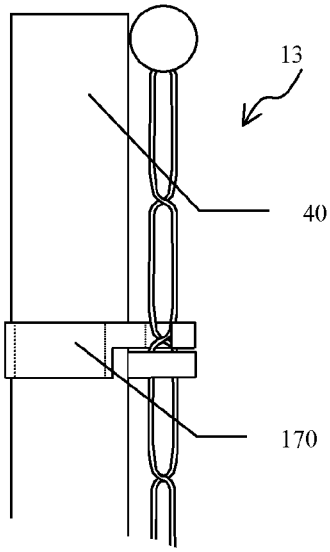
Figure 14D:
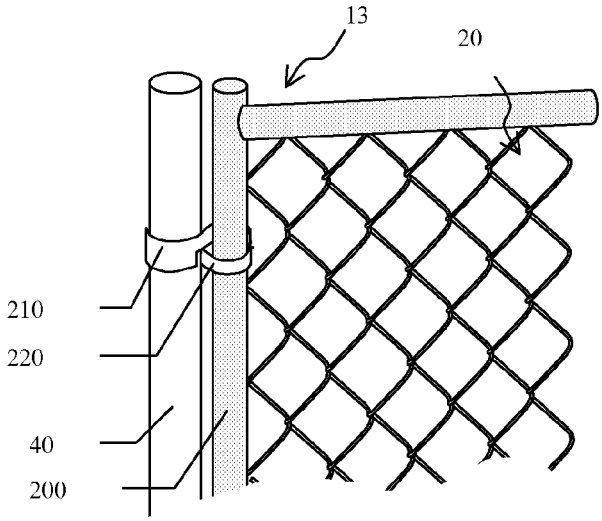
Figure 14E:
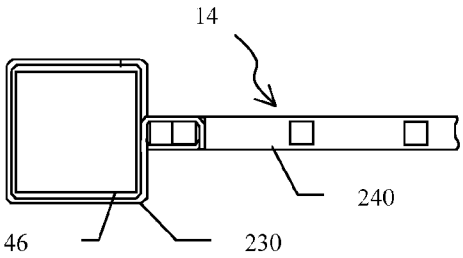
Figure 14F:
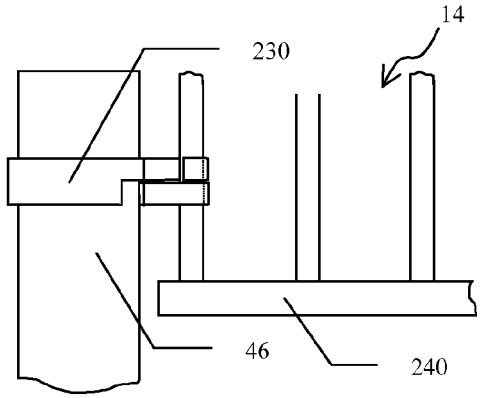

FIGS. 11(*a*)-(*c*) show another of the many combinations of the previously described elements of the invention, this one being combined with additional features such as using a locking pin or clip 155 to secure one or more of the horizontal wires 35 into the notches 130 of the post 41. FIGS. 11(*b*) and (*c*) show how the formed stiffening section 36 can be of alternate shapes such as trapezoidal, placing multiple horizontal wires 35 outside of the generally planar surface 20 of the panel 12.

FIG. 12(*a*) illustrates the bracket 70 previously described in FIG. 3(*a*) of appropriate dimensions that it can be used to secure one or more of the planar 20 horizontal wires of the panel into the notches 130 of the post 41 as illustrated in FIGS. 12(*b*) and 12(*c*). FIG. 12(*d*) shows this same approach being used with a studded tee post 45 (prior art FIG. 8(*g*)).

FIG. 13(*a*) is another of the many alternate bracket 170 embodiments of the invention. In this embodiment the closed style pocket 24 is sized so that when installed in the structure any inward movement of the side walls 172 is prevented by the post. The side walls 172 are formed in a fashion (best illustrated in FIG. 13(*d*)) so that they cross one another 180 and then turn back forming opposing overlapping hooks 185 (*a*) and 185(*b*) to form an engagement housing 190. The chamber 192 of the engagement housing is selectively sized and shaped to trap a wire of one or more panels. As illustrated in the side view of FIG. 13(*b*) and the top view of FIG. 13(*c*) of the installed bracket 170, this cross clipping action is achieved by flexing the walls 172 of the bracket together which in turn opens the engagement housing 190 permitting it to be placed around a portion of the panel 10. By inserting the post 40 though the pocket 24 of the bracket 170 the engagement housing 190 is locked to the panel 10 connecting the post and panel forming the structure. FIG. 13(*d*) illustrates the bracket 170 connecting two panels 10(*a*) and 10(*b*) to a post 40. FIG. 13(*e*) illustrates an alternative embodiment of the bracket 175 of FIG. 13(*a*) wherein the engagement housing 178 is altered to permit limited movement in one direction while allowing generous tolerances in other directions. As previously described these generous tolerances can allow for field adjustment in the placement and/or pitch of panel 10(*b*) relative to 10(*a*). FIGS. 13(*f*) and 13(*g*) illustrate that the brackets of the invention can be modified in their shape and size as appropriate to the post size and shape such as the round bracket 210 and the square bracket 230. Further the engagement housing may be modified as appropriate to the element of the panel or panels that they connect to such as engagement housing 220 for a tubular connection. As further illustrated in FIG. 13(*f*) the walls 215 of the bracket 210 are opposing rather than generally parallel as illustrated in other embodiments of the bracket(s) of the invention.

FIG. 14(*a*) illustrates the bracket of FIG. 13(*a*) used to connect an alternative panel 13 such as one constructed of chain link mesh attached to a tubular frame 200 to a post 40. The bracket 170 is clipped to the generally planar mesh 20, securing it to the post as illustrated in the top view of FIG. 14(*b*), and the side view of FIG. 14(*c*). FIG. 14(*d*) is a perspective view of bracket 210 alternatively formed with a round post pocket and an engagement housing 220 formed to secure the upright tubular element of a chain link panel 200. Similarly FIG. 14(*e*) and FIG. 14(*f*) are top and front views of yet another alternative embodiment of the invention using an ornamental picket panel 240 connected to a square post 46 with a bracket 230.

Persons of ordinary skill in the art will understand that retainer clips of the invention can be used in many applications other than those shown in the drawings and described above. These include (by way of example and not by way of limitation) fence sections (flat wire, with or without strengthening deformation bends, chain link, ornamental picket, etc.) to clip on one or more posts in any or multiple directions (vertical, horizontal, or at any angle). The invention can be practiced for the primary support post, or for supplemental support posts/tubing/elements. Further regarding supplemental supports or bracing, the main support for the fence could be provided in any suitable manner (including permanent posts), and the clips/sections of posts could be added to "stiffen" the fence/barrier at any desired location.

The apparatus and methods of the present invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

What is claimed is:

1. A fence assembly comprising a first panel having a generally planar surface of spaced apart wires;

at least one retaining bracket; and a vertical post;

wherein the post is retained generally between the panel and the bracket by attachment of the bracket to the spaced apart wires without physically separable connecting elements, wherein the bracket includes a first pocket configured to receive the vertical post, the first pocket formed at least in part by a first pair of spaced apart sides of the retaining bracket, each side including engagement surfaces extending therefrom, the sides capable of being fitted about the vertical post to permit attachment of the surfaces to corresponding spaced apart wires of the first panel, the fence assembly further including a second panel having a generally planar surface of spaced apart wires, wherein the bracket includes a first housing formed along one of the sides, the first housing configured to receive and retain at least one spaced apart wire of the second panel to facilitate attachment of the first panel and the second panel to the vertical post, wherein the first pocket is closed and inserted between the spaced apart wires of the first panel such that the vertical post is received into the first pocket.

2. The assembly of claim 1, wherein the engagement surfaces are outwardly extended.

3. The assembly of claim 1, wherein at least one of the first panel and the second panel includes at least one generally linear stiffening bend.

4. The assembly of claim 3, wherein the bend is configured to receive the vertical post between spaced apart elements that form the bend.

* * * * *